US005823452A

United States Patent [19]

Ballew et al.

[11] Patent Number: 5,823,452

[45] Date of Patent: Oct. 20, 1998

[54] FLAKER MILL

[76] Inventors: Russell Ballew; Dale Cleavinger, both of P.O. Box 630, Dalhart, Tex. 79022

[21] Appl. No.: 841,792

[22] Filed: May 5, 1997

[51] Int. Cl.[6] ..... B02C 4/06

[52] U.S. Cl. ..... 241/225; 241/232; 241/235

[58] Field of Search ..... 241/6–13, 101.2, 241/225, 230–235, 285.1, 285.2, 285.3

[56] References Cited

U.S. PATENT DOCUMENTS

| | | |
|---|---|---|
| 3,880,367 | 4/1975 | Grover . |
| 3,881,663 | 5/1975 | Brown . |
| 4,154,408 | 5/1979 | Boling, Jr. . |
| 5,386,946 | 2/1995 | Fetzer . |
| 5,544,823 | 8/1996 | Baltensperger et al. . |

*Primary Examiner*—Mark Rosenbaum
*Attorney, Agent, or Firm*—Richard C. Litman

[57] ABSTRACT

A flaker mill provides for the flaking or rolling of processed grains such as corn and milo for livestock feed. The mill is powered by a relatively small motor which turns at a higher speed than the drive sheaves for the two rollers within the machine. A speed reduction transmission, such as a planetary transmission, is used to reduce the motor output speed to the proper speed to drive an output sheave from the transmission and to provide the proper torque for the two rollers. Each of the rollers has a sheave extending therefrom, for a total of only three sheaves for the entire machine to drive the two rollers. The machine does not require an idler pulley or sheave for belt tension adjustment, as the arcuate adjustment motion of the rear roller bearing housings disposed between the fixed front roller bearing housings and the transmission output, substantially compensates for positional changes in the belt run. The motor and transmission are adjustably positioned, for belt replacement and to adjust for belt stretch. The lack of a separate idler pulley, and use of a geared transmission for speed reduction, reduces frictional losses in the drive system and allows a smaller motor to be used, thus resulting in substantial economies of operation. The nip space between the two rollers is adjusted using hydraulic struts between bearing housing extension arms on each side, with a spring providing additional compliance in the event of a non-crushable article passing through the roller nip.

20 Claims, 4 Drawing Sheets

FLAKER MILL

BACKGROUND OF THE INVENTION

1. Field of the Invention

The present invention relates generally to rolling and comminuting machinery, and more specifically to improvements in a machine used for crushing and flaking grains for animal feed. The present flaker mill uses a relatively small motor and a planetary speed reduction gearbox to develop the desired operational speed. This results in a requirement for relatively fewer pulleys or sheaves and their associated belts, thus reducing frictional losses.

2. Description of the Related Art

The processing of grain for animal feed has been done for hundreds of years, with the technology ranging from manual crushing of dried grain to the present powered machinery. Typically, grain is steamed in a cooker above the milling machine(s), and then passed through a feeder box atop each machine, which adjusts the flow of the grain through the rollers of the flaker mill. The rollers turn opposite to one another, with a small but adjustable gap therebetween. Power is typically provided by a large electric motor powering the rollers via a complex run of drive belts over a large number of pulleys or sheaves to provide adjustability, resulting in relatively high power losses due to friction.

The present machine utilizes a different means of powering and adjusting the rollers, thus requiring a relatively small motor to provide the required power. The use of a planetary gearbox also results in a more efficient motor speed reduction than is achieved by using belts, as in the related art, with the present flaker mill providing a considerably more efficient and cost effective means of processing feed grain. A discussion of the related art known to the present inventors, and its distinctions and differences from the present flaker mill invention, is provided below.

U.S. Pat. No. 3,880,367 issued on Apr. 29, 1975 to Herman J. Grover describes a Grain Mill for grinding small amounts of grain, as in home use. The Grover mill includes two concentric stones having a small space therebetween, with one stone being stationary and the other rotating. A shearing action occurs between the faces of the two stones, rather than a pressing and rolling action as provided by the parallel rollers of the present mill.

U.S. Pat. No. 3,881,663 issued on May 6, 1975 to Andrew M. Brown describes a Roll Mill For Flaking Grain And The Like. The machine includes two parallel rollers which are set in tracks or slots in each side wall of the housing. Brown provides for ease of removal of the rollers, with positioning arms which hold them in place. Manually operated lever arms are provided to adjust the spring force urging the two rollers together, unlike the hydraulic means used in the present machine. Also, the Brown machine rollers adjust linearly, while the adjustable roller of the present machine adjusts arcuately. No motor speed reduction is disclosed by Brown.

U.S. Pat. No. 4,154,408 issued on May 15, 1979 to James F. Boling, Jr. describes a Flaking Mill Adjustment And Shock Absorbing Means, comprising a hydraulic strut disposed between the two rollers of the mill. One end of the strut is affixed to a fixed arm extending from one of the roller bearings, while the opposite strut end is secured to an adjustable roller bearing arm. A pneumatic cylinder extends from the end of the adjustable arm opposite the hydraulic strut, to allow momentary spreading of the rollers in the event that an object larger than the spacing between the rollers, passes through the machine. The present machine uses an adjustable coiled spring to accomplish this shock absorbing action, rather than the more complex pneumatic device. No drive means or motor speed reduction is disclosed by Boling, Jr.

U.S. Pat. No. 5,386,946 issued on Feb. 7, 1995 to Wilhelm Fetzer describes a Flaking Mill With A Product Channel On Each Of The Axial Ends Of The Rollers. Fetzer responds to the problem of material passing beyond the ends of the rollers and thus not passing through the roller nip to be rolled or flaked. While the machine of the present invention may incorporate such structure, it is beyond the scope of the present disclosure, which is directed primarily to novel drive means for such machines. Fetzer does not disclose any drive means, other than to show one sheave and to note that the roller drive may include a drive sheave and transmission (column 2, lines 56 and 57). Fetzer is silent regarding the use of a motor and any specifics relating to motor speed reduction and/or transmission.

Finally, U.S. Pat. No. 5,544,823 issued on Aug. 13, 1996 to Werner Baltensperger et al. describes Apparatus For The Production Of Milled Grain Products And Grain Milling System. The machine comprises at least four rollers providing sequential double grinding of material therethrough, and includes control gates, air ducts, and other structure beyond the scope of the present flaker mill machine. No drive means for the rollers, or specific means of automatically adjusting the nip space between the rollers, is disclosed by Baltensperger et al. The Baltensperger et al. apparatus is directed to the fine grinding of grains for human consumption, particularly in baked goods where a fine and homogeneous consistency is required. Such fine grinding is undesirable in the animal feed industry, to which the present flaker mill is directed.

None of the above inventions and patents, either singly or in combination, is seen to describe the instant invention as claimed.

SUMMARY OF THE INVENTION

The present invention comprises a flaker mill for rolling or milling grains used in animal feed, such as corn, milo, etc. The present flaker mill uses a novel power transmission system, in which power transmission losses are cut considerably over such devices of the prior art. An electric motor drives a speed reducing transmission, which in turn drives counter rotating roller sheaves, eliminating the need for larger sheaves for speed reduction and for an idler sheave, for greater efficiency.

Accordingly, it is a principal object of the invention to provide an improved flaker mill for processing grains for animal feed, comprising a housing having a pair of counter rotating rollers therein separated by a narrow nip space therebetween and including a roller drive system.

It is another object of the invention to provide an improved flaker mill which roller drive system comprises an electric motor driving a planetary or other geared speed reduction transmission, thereby reducing frictional power losses in the speed reduction system, and which transmission drives a pair of roller sheaves to drive the two rollers without need for an idler sheave.

It is a further object of the invention to provide an improved flaker mill including roller nip space adjustment means, comprising arcuately pivotable roller bearing housings on each end of one of the rollers.

Another object of the invention is to provide an improved flaker mill which includes hydraulic roller nip adjustment means, and spring means allowing the nip space to increase as required for the passage of non-crushable objects between the rollers.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
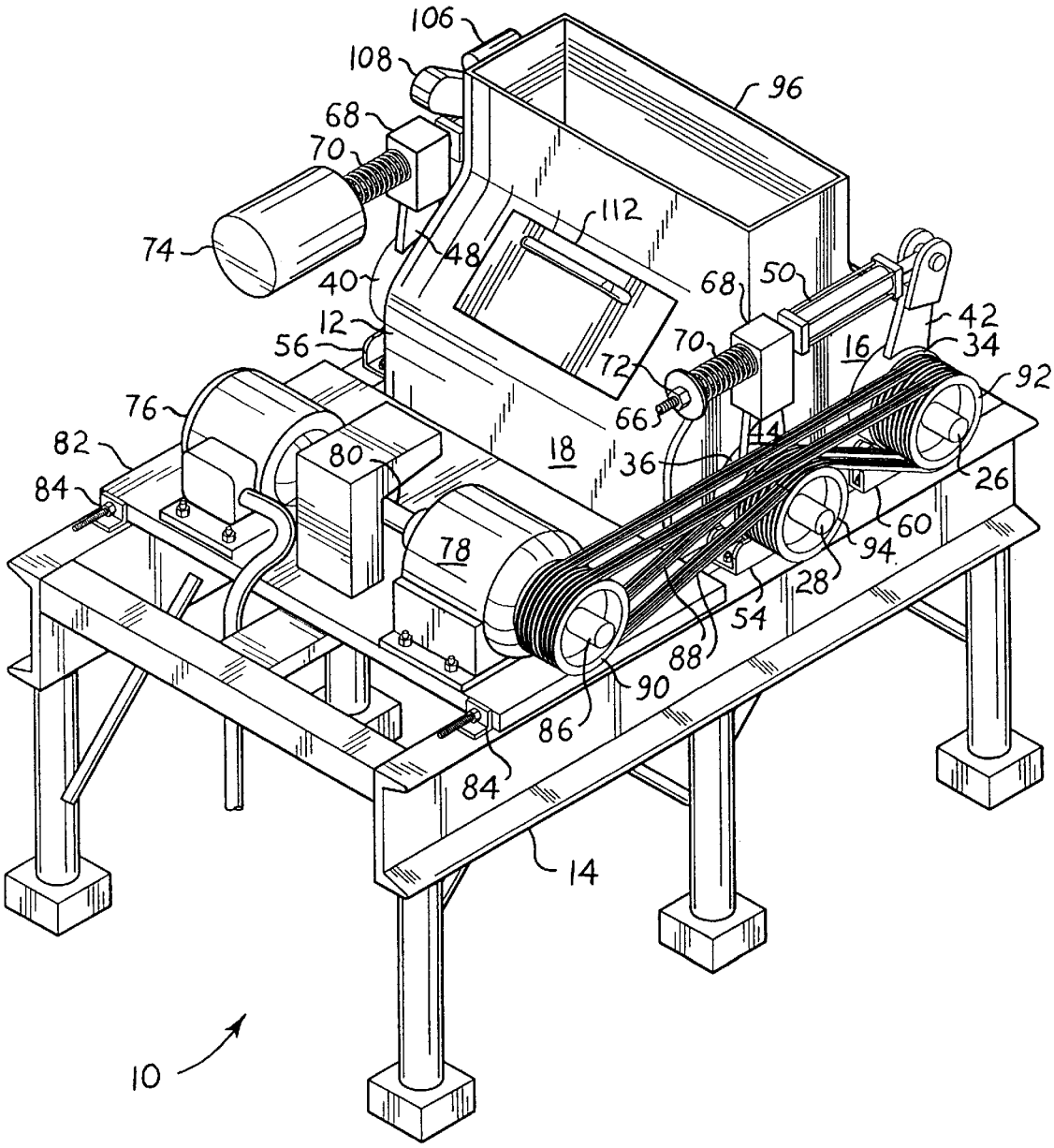
FIG. 1 is a rear perspective view of the present flaker mill invention, showing the drive motor, transmission, and belt drive to the two roller sheaves, as well as other features.

The present invention comprises a flaker mill, indicated by the reference numeral 10 throughout the drawings. The present flaker mill 10 serves to roll or flake grains such as corn, milo, etc., for use in the livestock feed industry. The grains are generally first steamed in a steam cooker, which is beyond the scope of the present disclosure, and then are fed through the flaker mill 10 for further processing and flaking to the desired consistency, size, shape, and thickness for use as animal feed.

Figure 2:
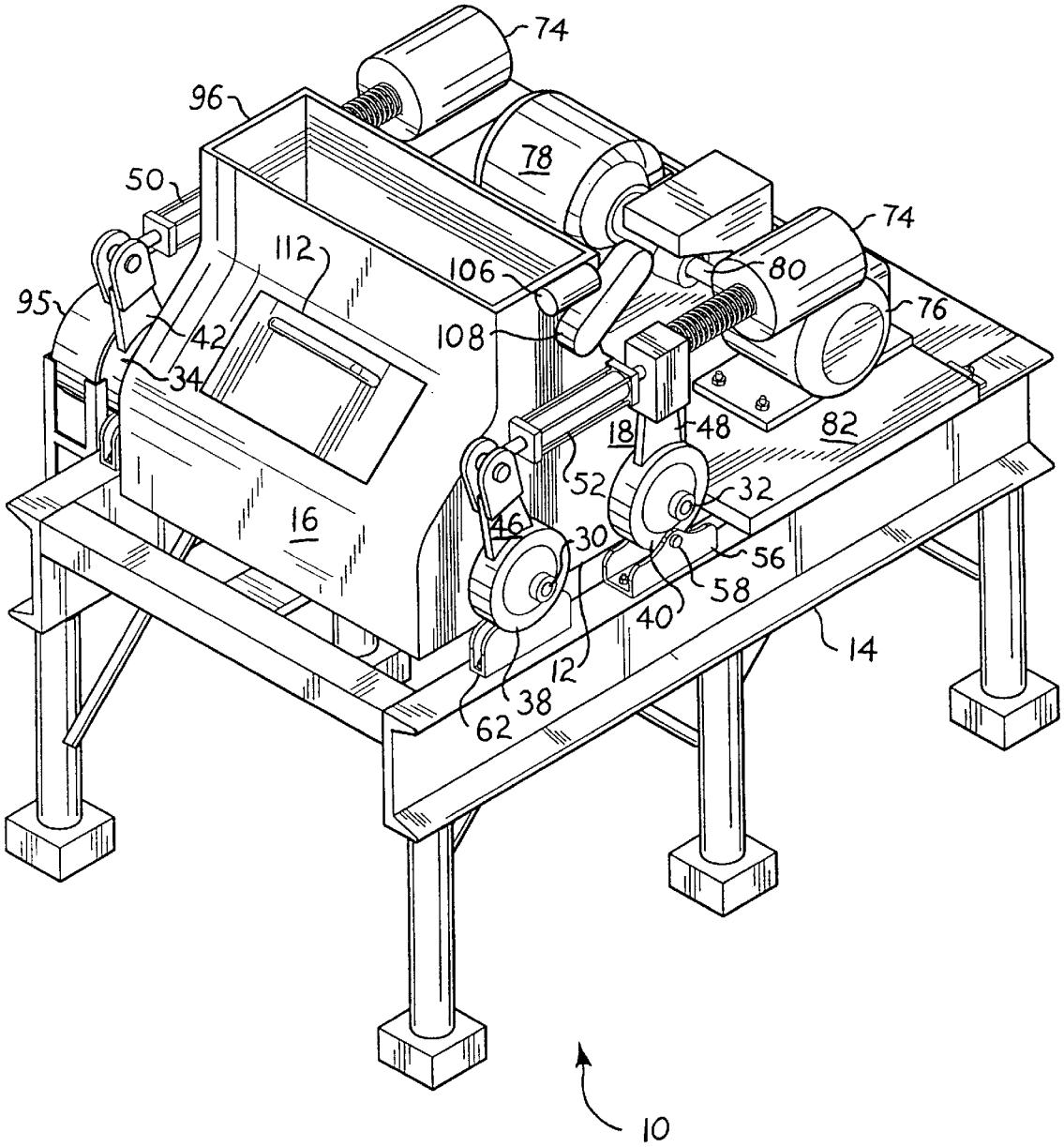
FIG. 2 is a front perspective view of the flaker mill, showing the arcuately pivotable bearing housing for the rear roller and other features.
Figure 3:
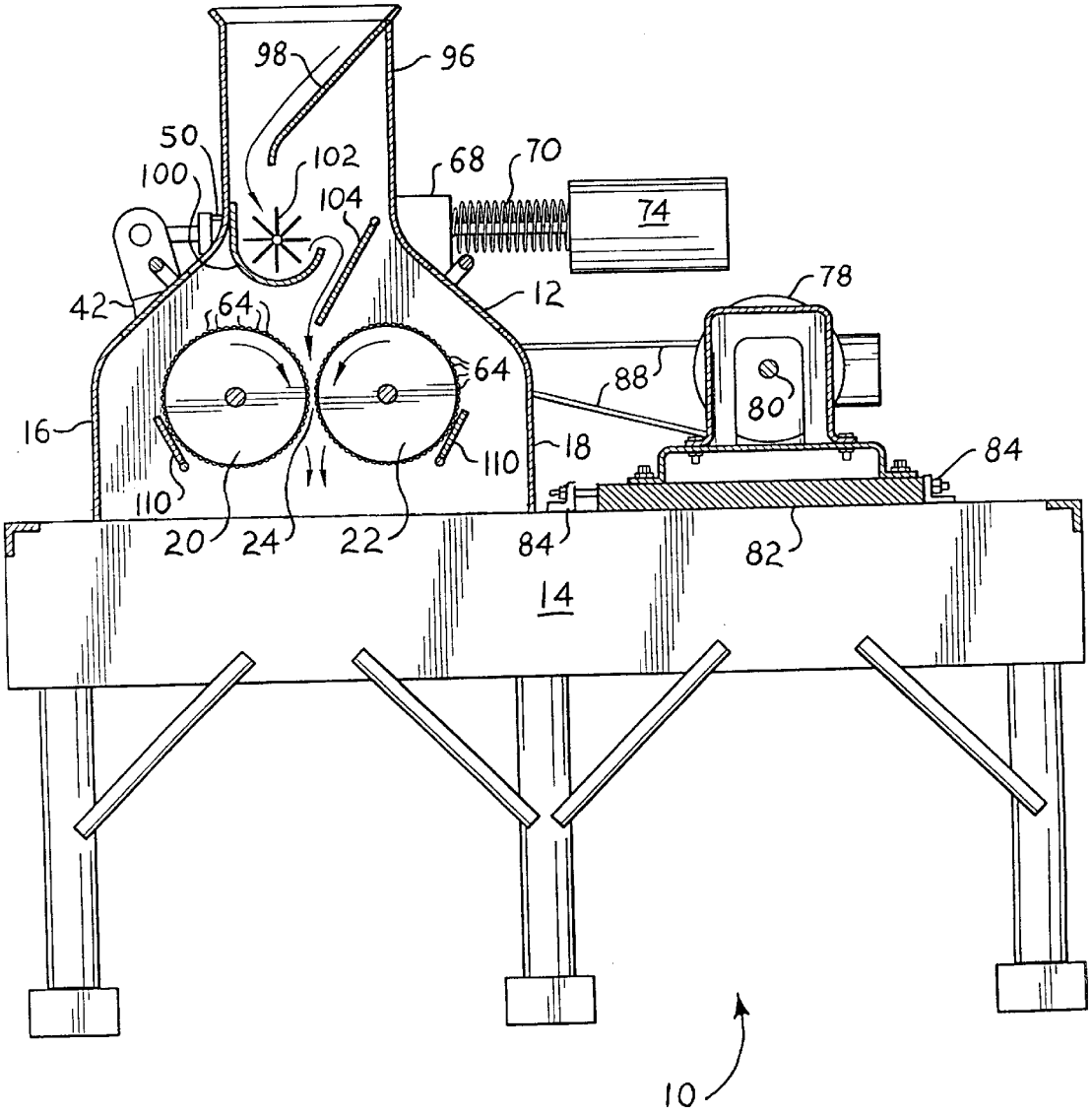
FIG. 3 is a side elevation view in section of the present flaker mill, showing various internal components thereof.

FIGS. 1 and 2 respectively provide rear and front perspective views of the present flaker mill 10. The mill 10 generally comprises a housing or enclosure 12, which is installed atop a sturdy frame 14 built up of structural channel members, columns, etc. to support the weight and vibration of the operating mill 10. The housing 12 has a front portion or area 16 and an opposite rear portion or area 18, respectively containing a laterally disposed front roller 20 and parallel rear roller 22, as shown in the internal view of FIG. 3. These two rollers 20 and 22 are positioned within the cabinet or housing 12 with very little clearance therebetween, defining a pinch or nip area 24 therebetween, through which grains such as corn, milo, etc. are passed for rolling and flaking.

Each of the rollers 20 and 22 has an axial roller drive shaft, respectively 26 and 28, extending from one end thereof (FIG. 1), and an opposite axial roller support shaft, respectively 30 and 32, extending from the opposite end thereof (FIG. 2). The shafts 26 through 32 are supported in bearing housings, respectively a front roller drive shaft bearing housing 34, a rear roller drive shaft bearing housing 36, a front roller support shaft bearing housing 38, and a rear roller support shaft bearing housing 40. The drive shaft bearing housings 34 and 36 are shown in FIG. 1, while the support shaft bearing housings 38 and 40 are shown in FIG. 2. (It will be seen that the term "drive shaft bearing housing" is used to indicate the driven end of each roller and that the bearing housings also provide support for the driven ends of the rollers.)

Each of the bearing housings 34 through 40 has an arm extending upwardly therefrom, respectively arms 42 through 48, which provide for adjustment of the nip space or gap 24 between the front and rear bearing housings (and thus between the two rollers 20 and 22). The two drive shaft bearing housing arms 42 and 44 have a first hydraulic strut or ram 50 extending therebetween, with the support bearing housing arms 46 and 48 having a second hydraulic strut 52 extending therebetween. These two struts are hydraulically interconnected (the connection is not shown, but comprises conventional hydraulic lines, fittings, etc.) to adjust the spacing between each pair of arms 42, 44 and arms 46, 48, thereby adjusting the nip space 24 between the two rollers 20 and 22.

The spacing between the arms 42, 44 and 46, 48 is adjustable due to the pivotal mounting of the two rear bearing housings 36 and 40 to their respective bases 54 and 56 by means of a pivot pin or bolt 58 (one of which is shown in FIG. 2), while the two front bearing housings 34 and 38 are immovably affixed to their respective bases 60 and 62. Thus, the extension of the two struts 50 and 52 applies a compressive force from the fixed front bearing housing arms 42 and 46, to cause the two movable rear bearing arms 44 and 50 to pivot arcuately away from the front arms 42 and 46, thus widening the nip gap 24 between the two rollers 20 and 22. Retraction of the two struts 50 and 52 reverses the above process, and draws the two rollers 20 and 22 closer together to reduce the nip space or area 24 therebetween.

Normally, the two rollers 20 and 22 are positioned quite closely together, to leave a nip space or area 24 of only a small fraction of an inch therebetween. Normally, this is sufficient to cause the steamed grain to be crushed or flaked between the two rollers 20 and 22, and as noted above, the nip gap 24 may be adjusted for different grains, processing, and/or for other reasons as desired. The two rollers are preferably provided with a multitude of axially parallel corrugations 64 disposed over their surfaces, which corrugations 64 assist in drawing the grain between the two rollers 20 and 22 for processing. However, in the event that a non-crushable object falls between the two rollers 20 and 24, it will also be drawn between the two rollers 20 and 22.

Accordingly, the two hydraulic struts 50 and 52 each include an extension 66 (one of which is shown in FIG. 1), which passes through the distal end 68 of each of the arcuately movable rear arms 44 and 48. Each of the extensions includes a coil compression spring 70 thereon, which is captured on its respective extension 66 by a threaded nut and washer assembly 72, or other suitable adjustable means. (A guard or cover 74, shown removed from the drive side spring 70 and nut and washer assembly 72 in FIG. 1, may be installed over each of the assemblies if desired.) Thus, in the event that an incompressible or essentially non-deformable object (stone, nut or bolt, etc.) falls between the two rollers 20 and 22, the rollers 20 and 22 will be forced apart to allow the object to pass therebetween, with the two arm pairs 42, 44 and 46, 48 likewise being forced apart against the pressure of the springs 70. When the object has passed through the nip space 24, the springs 70 force the arm pairs 42, 44 and 46, 48 back together, thus also closing the nip space 24 to that previously set by means of the hydraulic struts 50 and 52 between the respective arm pairs 42, 44 and 46, 48.

Figure 4:
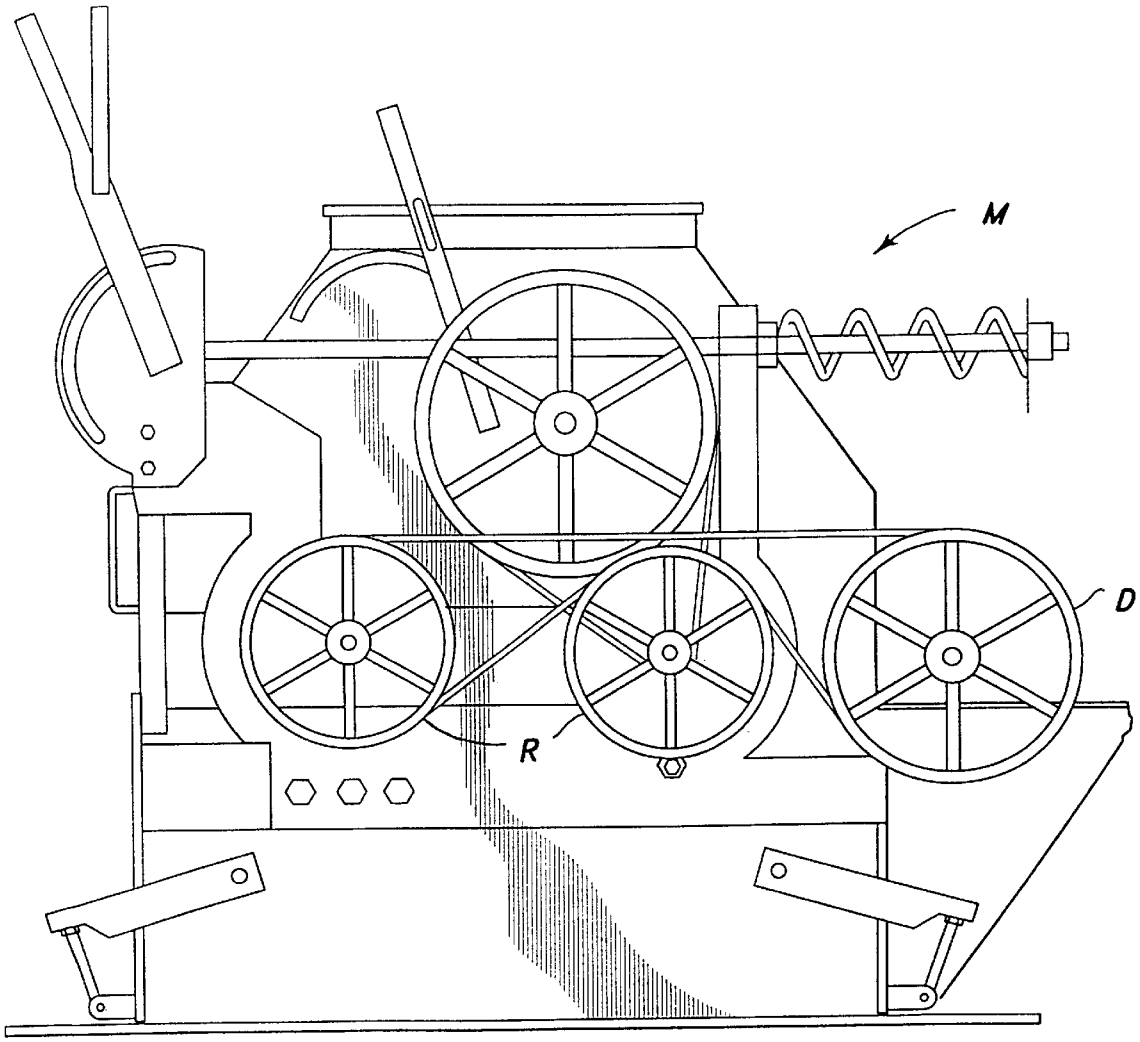
Fig. 4 (PRIOR ART)
FIG. 4 is a side elevation view of a prior art flaker mill, showing the complex belt drive therefor and the lack of motor speed reducing means.

The present flaker mill 10 is powered by a relatively small electric motor 76, on the order of twenty to thirty horsepower. Other types of motors (hydraulic, pneumatic, etc.) may be substituted, if so desired. The power required to operate the motor 76 is considerably less than the sixty or seventy horsepower motors required of other flaker mills capable of processing about the same volume of grain as the present mill 10, due to the novel drive system used in the present mill 10. The motor 76 drives a motor speed reduction transmission 78 (planetary gear reduction, as shown, or other speed reduction means) by means of a drive shaft 80, rather than using a large and relatively slow speed motor with a relatively large drive pulley or sheave D to provide a speed increase to the roller sheaves R, as is shown in the related art mill M of FIG. 4. The smaller, and fewer, sheaves or pulleys also result in a reduction of friction over the larger and greater number of sheaves or pulleys used in such mills of the related art, and reduce the overall size of the machine. The use of a geared transmission for speed reduction results in considerably less friction loss than the use of pulleys, sheaves and belts for changing the speed of a motor output, thus allowing the use of a relatively smaller motor than that used in other such machines.

The motor 76 and transmission 78 are installed on a base 82, which is adjustably installed to the rear of the housing 12 on the underlying frame 14. The base 82 is adjusted by adjusters 84, comprising a threaded rod extending from the base 82 through angles secured to the frame 14; other adjustment means may be used. The adjusters 84 allow the base 82, with the motor 76 and transmission 78 immovably affixed thereto, to be moved relative to the housing 12 and the rollers 20 and 22 to adjust the tension of the belt(s) extending from the transmission 78 to the rollers 20 and 22.

As noted above, the present flaker mill 10 uses one or more belt(s) to transfer power from the transmission output shaft 86 to the two rollers 20 and 22, as best shown by the multiple belts 88 in FIG. 1. Accordingly, the output shaft 86 is equipped with an output pulley which may comprise one or more sheaves 90 in order to run one or more belts 88 therein. The front and rear rollers 20 and 22 are also respectively equipped with a front roller drive sheave(s) 92 and a rear roller drive sheave(s) 94. The belt(s) 88 pass around the transmission and front roller sheaves 90 and 92 in a first direction, with the lower side of the belt(s) 88 passing over the top of the rear roller sheave(s) 94, causing the rear roller 22 to rotate in a second direction opposite that of the front roller 20. The motor 76 turns the transmission 78, and thus the front roller 20 and the rear roller 22, so adjacent portions of the two rollers 20 and 22 defining the nip area 24 are moving downwardly, to pull grain downwardly through the rollers 20 and 22. (A guard 95 is installed over the belt and sheaves in FIG. 2.)

The pulleys or sheaves 90, 92, and 94 of the present flaker mill 10 are all of substantially the same size, with the transmission output sheaves 90 perhaps being slightly larger in diameter than the two roller drive sheaves 92 and 94. As the output sheaves 90 must transmit all of the torque developed by the motor and transmission combination, the sheave(s) must be of some minimum size. A transmission output sheave 90 on the order of sixteen inches in diameter has been found to work satisfactorily in testing with the present flaker mill 10. However, the two roller sheaves 92 and 94 may be somewhat smaller, as each is absorbing only a portion of the torque transmitted from the output sheave 90 by means of the belt(s) 88. Twelve inch diameter roller sheaves 92 and 94 have been found to be satisfactory in testing. This results in a very compact arrangement, with relatively few moving parts.

The motor 76 used with the present invention turns at approximately 1800 rpm, with the present planetary gear transmission 78 reducing this speed by about six to one, to turn the transmission output shaft 86 and its sheaves 90 at about 300 rpm. However, the 25% larger diameter of the output sheaves 90 in comparison to the roller drive sheaves 92 and 94, results in a 25% rpm increase to the two roller drive sheaves 92 and 94, to turn those two sheaves at a desired speed of about 400 rpm. It will be seen by those skilled in the art of flaker mills, that other motor speeds, transmission reduction ratios, and sheave diameters may be used without departing from the novel concept of the present invention.

By providing the nip space 24 adjustment by moving the rear roller 22, i. e., the roller between the front roller 20 and the transmission output sheaves 90, it will be seen that practically no adjustment is required for changing belt tension when the nip space 24 is adjusted. The front roller 20 and the motor and transmission assembly 76 and 78, along with the transmission output sheaves 90, remain essentially fixed relative to one another when the rear roller 22 is adjusted to adjust the nip space 24. As the rear roller 22 moves arcuately, rather than linearly, the rear roller sheave assembly 94 also travels arcuately, and will descend slightly as it moves either forwardly or rearwardly for adjustment from a substantially vertical position for the two arms 44 and 48.

Thus, as the top of the movable rear roller sheaves 94 approach either the positionally fixed front roller sheaves 92, or the transmission output sheaves 90, the arcuate action of the rear roller sheaves 94 causes the sheaves 94 to lower slightly, thus compensating for the movement toward the other sheaves 90 or 92. Linear motion would result in the movement of a central sheave toward a fixed sheave to either side thereof, causing the belts to take a tighter "wrap" about the sheaves toward which the central sheave was moved, as the central sheave would maintain the same height relative to the other two sheaves. Thus, the present flaker mill 10, with the forward roller 20 and sheaves 92 being fixed while the rear roller 22 and sheaves 94 are arcuately adjustable between the forward roller sheaves 92 and transmission output sheaves 90, results in practically no change in tension in the belts.

Steamed feed grain is fed into the present flaker mill 10 through a feeder cabinet 96, which extends upwardly from the roller housing 12. The feeder cabinet 96 receives the partially processed grain from a chute or distribution means (not shown) which is disposed above the flaker mill 10 assembly, and dumps the grain product into the top of the feeder cabinet 96. The side elevation view in section of FIG. 3 discloses the operation of the feeder cabinet 96, as well as the remainder of the present flaker mill 10.

A baffle 98 within the upper portion of the feeder cabinet 96 diverts the grain entering the cabinet 96, causing it to fall into a feed distribution trough 100 above the two rollers 20 and 22. A rotary peg feeder 102 is disposed immediately above the trough 100, with a plurality of radial pegs extending from the peg feeder shaft rotating downwardly into the trough 100 to kick out grain as it falls into the trough 100, and distribute the grain product more or less evenly to the rollers 20 and 22 below. A guide vane or baffle 104 is positioned to guide the grain as it is kicked from the trough 100 by the peg feeder 102, to cause the grain to fall generally into the nip area 24 between the two rollers 20 and 22.

The peg feeder 102 is powered by an electric motor 106 which drives the feeder 102 through a conventional belt or chain drive (shown covered by a guard 108), with the motor 106 and drive being shown generally in FIGS. 1 and 2. Other types of motors (hydraulic, pneumatic, etc.) may be provided as desired. The peg feeder motor 106 is preferably a variable speed motor, to optimize the action for the amount of grain flow through the cabinet 96.

As the grain product is distributed more or less evenly into the nip area 24 between the two rollers 20 and 22, it is rolled or flaked to a dimension essentially equal to that defining the width of the nip area 24, according to the adjustment of the nip area 24 as described further above. The corrugations 64 of the two rollers 20 and 22 help to preclude sticking of the grain product to the rollers to any great extent. Additional means to prevent the grain product from sticking to the rollers 20 and 22 is provided by scrapers 110 (shown in FIG. 3), one of which bears against each of the rollers 20 and 22 to remove grain which may be stuck thereto. Inspection doors or panels 112 in the housing 12 provide access to inspect and check the roller mechanism. The rolled and flaked grain product then falls from the bottom of the housing 12, where it is collected and/or conveyed for further processing or distribution (not shown).

In summary, the present flaker mill 10 will be seen to provide a significant advance in the economy of operation of such mills, due to the great reduction in the size of the drive motor being used. Motors typically used in conventional flaker mills are from 75 to 125 hp, whereas the present motor is on the order of only 25 to 30 hp to accomplish the same amount of work, due to the reduced friction provided by the transmission and the smaller output sheaves and thus roller drive sheaves required. The savings in electrical energy are significant, being up to sixty percent due to the advantages provided by the above described structure.

The present flaker mill is also highly durable, with at least the feeder cabinet, and preferably the entire housing, being formed of stainless steel to reduce cleanup requirements and other maintenance. The bearing housings are preferably formed of steel, rather than conventional cast iron, for greater durability, and the roller shaft bearings are preferably spherical bearings in order to allow for slight misalignments of the shafts, therefore providing reduced wear over that of conventional bearings running with a slight misalignment. The geometry of the belt and sheave arrangement allows adjustment of the rearward roller between the fixed forward roller and the transmission, without any significant change in belt tension, as described further above. Except for the need to replace belts from time to time, and the fact that the belts stretch over a period of time, all motor and transmission positional adjustment could be eliminated from the present machine, if desired, without affecting the operation of the rear roller adjustment. Thus, the present flaker mill will be seen to provide numerous advantages over earlier machines, and will provide significant economies of operation for users of the present machine.

It is to be understood that the present invention is not limited to the sole embodiment described above, but encompasses any and all embodiments within the scope of the following claims.

We claim:

1. A flaker mill, comprising:

a frame;

a housing extending upwardly from said frame, with said housing having a front area and a rear area therein;

a single front roller positionally fixed within said front area of said housing;

a single rear roller adjustably positioned within said rear area of said housing;

said front roller and said rear roller each having an axial roller drive shaft extending therefrom and an opposite axial roller support shaft extending therefrom;

a rearwardly disposed drive motor behind said rear roller;

a speed reduction transmission connected to said motor by a drive shaft extending therebetween;

said transmission having an output shaft with an output sheave affixed thereto;

said front roller drive shaft having a front roller drive sheave affixed thereto and said rear roller drive shaft having a rear roller drive sheave affixed thereto;

at least one drive belt extending about said output sheave and said front roller drive sheave in a first direction, and about said rear roller drive sheave in an opposite second direction; and said front roller and said rear roller rotating in opposite directions and at substantially the same speed, and defining a narrow, adjustable nip area therebetween for processing grain for animal feed.

2. The flaker mill according to claim 1, wherein each said roller support shaft and each said roller drive shaft is supported within a bearing housing, with said rear roller support shaft bearing housing and said rear roller drive shaft bearing housing each being pivotally secured to said frame for arcuately adjusting said nip area between said front roller and said rear roller.

3. The flaker mill according to claim 2, wherein each said bearing housing includes an arm extending generally upwardly therefrom, with said arm of said front roller drive shaft bearing housing and said arm of said rear roller drive shaft bearing housing being adjustably secured together by a first hydraulic strut and said arm of said front roller support shaft bearing housing and said arm of said rear roller support shaft bearing housing being adjustably secured together by a second hydraulic strut.

4. The flaker mill according to claim 3, wherein each said hydraulic strut includes a shaft extending through a respective said arm of said rear roller drive shaft bearing housing and said arm of said rear roller support shaft bearing housing, with each said hydraulic strut shaft including a coiled compression spring adjustably installed thereon for providing compliance between each said roller for non-compressible objects passing therebetween.

5. The flaker mill according to claim 1, wherein said motor and said transmission are adjustably secured to said frame for adjusting the tension of said at least one drive belt.

6. The flaker mill according to claim 1, wherein said motor is electric.

7. The flaker mill according to claim 1, wherein said transmission has a planetary gear configuration.

8. The flaker mill according to claim 1, wherein said transmission has a speed reduction of substantially six to one.

9. The flaker mill according to claim 1, including a plurality of axially parallel corrugations disposed upon each said roller, for drawing feed grain through said nip area between each said roller.

10. A flaker mill, comprising:

a frame;

a housing extending upwardly from said frame, with said housing having a front area and a rear area therein;

a single front roller positionally fixed within said front area of said housing;

a single rear roller adjustably positioned within said rear area of said housing;

said front roller and said rear roller each having an axial roller drive shaft extending therefrom and an opposite axial roller support shaft extending therefrom;

a rearwardly disposed drive motor behind said rear roller;

a speed reduction transmission connected to said motor by a drive shaft extending therebetween;

said transmission having an output shaft with an output sheave affixed thereto;

said front roller drive shaft having a front roller drive sheave affixed thereto and said rear roller drive shaft having a rear roller drive sheave affixed thereto;

at least one drive belt extending about said output sheave and said front roller drive sheave in a first direction, and about said rear roller drive sheave in an opposite second direction;

said front roller and said rear roller rotating in opposite directions and at substantially the same speed, and defining a narrow, adjustable nip area therebetween for processing grain for animal feed; and a feeder cabinet extending upwardly from said housing, for distributing feed therethrough to said rollers within said housing.

11. The flaker mill according to claim 10, wherein each said roller support shaft and each said roller drive shaft is supported within a bearing housing, with said rear roller support shaft bearing housing and said rear roller drive shaft bearing housing each being pivotally secured to said frame for arcuately adjusting said nip area between said front roller and said rear roller.

12. The flaker mill according to claim 11, wherein each said bearing housing includes an arm extending generally upwardly therefrom, with said arm of said front roller drive shaft bearing housing and said arm of said rear roller drive shaft bearing housing being adjustably secured together by a first hydraulic strut and said arm of said front roller support shaft bearing housing and said arm of said rear roller support shaft bearing housing being adjustably secured together by a second hydraulic strut.

13. The flaker mill according to claim 12, wherein each said hydraulic strut includes a shaft extending through a respective said arm of said rear roller drive shaft bearing housing and said arm of said rear roller support shaft bearing housing, with each said hydraulic strut shaft including a coiled compression spring adjustably installed thereon for providing compliance between each said roller for non-compressible objects passing therebetween.

14. The flaker mill according to claim 10, wherein said motor and said transmission are adjustably secured to said frame for adjusting the tension of said at least one drive belt.

15. The flaker mill according to claim 10, wherein said motor is electric.

16. The flaker mill according to claim 10, wherein said transmission has a planetary gear configuration.

17. The flaker mill according to claim 10, wherein said transmission has a speed reduction of substantially six to one.

18. The flaker mill according to claim 10, including a plurality of axially parallel corrugations disposed upon each said roller, for drawing feed grain through said nip area between each said roller.

19. The flaker mill according to claim 10, including a rotary peg feeder disposed within said feeder cabinet, with said peg feeder having a feed distribution trough disposed therebelow.

20. The flaker mill according to claim 19, wherein said peg feeder is powered by an electric motor.

* * * * *